US005620833A

United States Patent [19]

Bogdanowicz et al.

[11] Patent Number: 5,620,833

[45] Date of Patent: Apr. 15, 1997

[54] CURVE SHAPE CONTROL IN A PHOTOGRAPHIC IMBIBITION DYE TRANSFER PROCESS

[75] Inventors: Mitchell J. Bogdanowicz, Spencerport; Charles P. Hagmaier, Rochester; Roger W. Nelson, Fairport, all of N.Y.

[73] Assignee: Eastman Kodak Company, Rochester, N.Y.

[21] Appl. No.: 614,454

[22] Filed: Mar. 12, 1996

[51] Int. Cl.[6] ..... G03C 1/815; G03C 5/26

[52] U.S. Cl. ..... 430/394; 430/199; 430/264

[58] Field of Search ..... 430/199, 394, 430/264

[56] References Cited

U.S. PATENT DOCUMENTS

| | | | |
|---|---|---|---|
| 2,837,430 | 6/1958 | Goldberg et al. | 430/292 |
| 2,907,657 | 10/1959 | Kott | 430/394 |
| 4,045,229 | 8/1977 | Weber, II et al. | 96/84 UV |
| 4,904,573 | 2/1990 | Hara | 430/394 |

*Primary Examiner*—Richard L. Schilling
*Attorney, Agent, or Firm*—Andrew J. Anderson

[57] ABSTRACT

A process for exposing dye imbibition printing matrix films is disclosed comprising imagewise exposing a matrix film comprising a visible light sensitive silver halide emulsion containing colloid layer on a support to blue, green or red light, wherein the visible light sensitive emulsion is also sensitive to UV light and the toe contrast of the imaged matrix film is controlled by (i) incorporating a UV absorber in the colloid layer of the matrix film, and (ii) flash exposing the matrix film with UV light in the substantial absence of light having a wavelength above 410 nm, wherein the UV absorber provides sufficiently low absorption above 410 nm such that it does not substantially alter the effective photographic speed of the matrix film during the imagewise exposure or the mid scale contrast of the imaged matrix film, and sufficiently high absorption to the UV light to decrease the resulting toe contrast of the imaged matrix film. In accordance with preferred embodiments of the invention, the above contrast control process is performed for each of the blue, green and red matrix films to be used in an imbibition printing process. The invention achieves desired toe contrast control of all three matrix films in the same manner. No longer does the blue matrix film require to be treated differently. This allows use of identical matrix films having blue, green and red sensitivity (e.g., a panchromatic sensitive film) in forming the separate blue, green and red exposed relief images if desired.

14 Claims, 5 Drawing Sheets

CURVE SHAPE CONTROL IN A PHOTOGRAPHIC IMBIBITION DYE TRANSFER PROCESS

This invention relates to a photographic imbibition printing dye transfer process and materials. It relates particularly to improved imbibition printing matrix films.

BACKGROUND OF THE INVENTION

The imbibition printing dye transfer process is well known. According to common procedures, a tanned colloid relief image is formed by imagewise exposure of a suitable light sensitive layer on a support, differentially hardening the colloid layer in accordance with the imagewise exposure, and removing the colloid from the support in inverse proportion to the amount of imagewise light exposure. The differential colloid hardening and removal is conventionally performed with a pyrogallol hardening developer as described, e.g., in U.S. Pat. No. 2,837,430, the disclosure of which is hereby incorporated by reference. For full color prints, three separate relief images corresponding to the blue, green, and red color records of the image being reproduced may be formed in separate blue, green, and red light sensitive matrix films by respective exposures with blue (approx. 400–500 nm), green (approx. 500–600 nm), and red (approx. 600–750 nm) light though a color negative film. The resultant colloid relief images are then dyed with yellow, magenta and cyan dyes, and the dye images transferred to a mordant-containing receiver film. In this manner imbibition printed colored dye images may be obtained which faithfully reproduce a colored subject.

The imbibition process normally results in a sensitometric Density vs. Log-Exposure curve shape with a relatively sharp (high contrast) "toe", or lower scale, region for the developed matrix films and resulting imbibition prints. The toe region is generally regarded as the curved region below the straight, or mid-scale, region of a D-LogE sensitometric curve. Reducing the toe area contrast, or "softening" the toe, is desirable to extend the latitude of the matrix film. One process which may be used to control the toe contrast is "flashing". Flashing is the non-selective low level exposure of a photographic material with the intent of softening the toe region of the sensitometric curve. While flashing of photographic materials to control contrast is a well known procedure, imbibition printing matrix films are unique in that the light sensitive layer of the matrix film generally has a large portion of a visible light absorbing non-photosensitive material, such as carbon particles, coated along with silver halide and colloid materials. The carbon absorbs light as it passes through the matrix film, thus concentrating the exposure towards the base (the exposure in this process is conventionally made through the base). A normal flash exposure with this type of material accordingly will not control the curve shape in the desired manner to the desired extent.

In years past, green and red matrix films having sufficient native blue sensitivity have been flashed with blue light in order to control the lower-scale sensitometry. A yellow dye was added to the matrix film which had the effect of lowering the contrast of the flash exposure. This allowed good control of the curve shape. The blue matrix film, however, could not use the yellow dye for the flash exposure control since the main image exposure is also made with blue light which would be absorbed by the yellow dye. Thus, the blue matrix film was flashed with blue light without the presence of a yellow dye.

Problem to be Solved by the Invention

In years past, coarser (larger grain size) emulsions were used with inherent lower toe contrasts. The blue matrix film (very coarse grain emulsion) was low enough in contrast that a minimal blue flash was required to control toe contrast. For blue matrix films made with modern fine grained emulsions, however, which are inherently relatively higher in contrast, there is not an effective blue flash toe contrast control. Additionally, when using green and red matrix films containing excess yellow absorber dye, there is a tendency for the film to become very brittle resulting in cracking and degradation of the dye image, as well as dirt generation in manufacture and use of the film. While the lower inherent contrast of previously used coarser emulsions required only relatively low levels of yellow absorber dye in the green and red matrix films for sufficient toe contrast control, modern fine grain emulsions used in the green and red matrix films are also inherently relatively higher in contrast and much larger quantities of the yellow absorber dye is needed to control the toe contrast. This can lead to physical problems such as tackiness, brittleness and film fracturing in manufacture of the film. It would be desirable to provide effective toe contrast control for each of the blue,.green and red imbibition printing matrix films without such physical problems, and especially to provide such control in a consistent manner.

SUMMARY OF THE INVENTION

This invention encompasses using a UV (Ultra Violet) absorber dye in a matrix film, and preferably in each of the blue, green and red matrix films, to attenuate light in the UV region, which for the purposes of this invention is defined as less than 400 nm. Preferably, the spectral characteristics of the UV absorber do not interfere with the main imagewise exposure of the matrix films.

In accordance with one embodiment of the invention, a process for exposing dye imbibition printing matrix films is disclosed comprising imagewise exposing a matrix film comprising a visible light sensitive silver halide emulsion containing colloid layer on a support to blue, green or red light, wherein the visible light sensitive emulsion is also sensitive to UV light and the toe contrast of the imaged matrix film is controlled by (i) incorporating a UV absorber in the colloid layer of the matrix film, and (ii) flash exposing the matrix film with UV light in the substantial absence of light having a wavelength above 410 nm, wherein the UV absorber provides sufficiently low absorption above 410 nm such that it does not substantially alter the effective photographic speed of the matrix film during the imagewise exposure or the mid scale contrast of the imaged matrix film, and sufficiently high absorption to the UV light to decrease the resulting toe contrast of the imaged matrix film.

In accordance with preferred embodiments of the invention, the above contrast control process is performed for each of the blue, green and red matrix films to be used in an imbibition printing process, wherein each matrix comprises a blue, green or red light sensitive silver halide emulsion which is additionally sensitive to UV light.

In accordance with another embodiment of the invention, a matrix film for use in imbibition printing is disclosed comprising a support bearing a colloid layer comprising (i) a visible light sensitive silver halide emulsion which is also sensitive to UV light, (ii) visible light absorbing non-photosensitive particles, (iii) a hydrophilic colloid, and (iv) a UV absorber having a peak absorbance between 360 and 410 nm.

The invention achieves desired toe contrast control of all three matrix films in the same manner. No longer does the blue matrix film require to be treated differently. This allows use of identical matrix films having blue, green and red sensitivity (e.g., a panchromatic sensitive film) in forming the separate blue, green and red exposed relief images if desired. The invention also allows greater control over matching the sensitometric contrast curves of the three matrix films. Additionally, the preferred UV absorber dyes absorb UV light more efficiently than the yellow dye previously used in green and red matrix films absorbed blue light such that much less dye is needed to attain a specific density, which results in good physical characteristics of the matrix films.

DETAILED DESCRIPTION OF THE INVENTION

Figure 1:
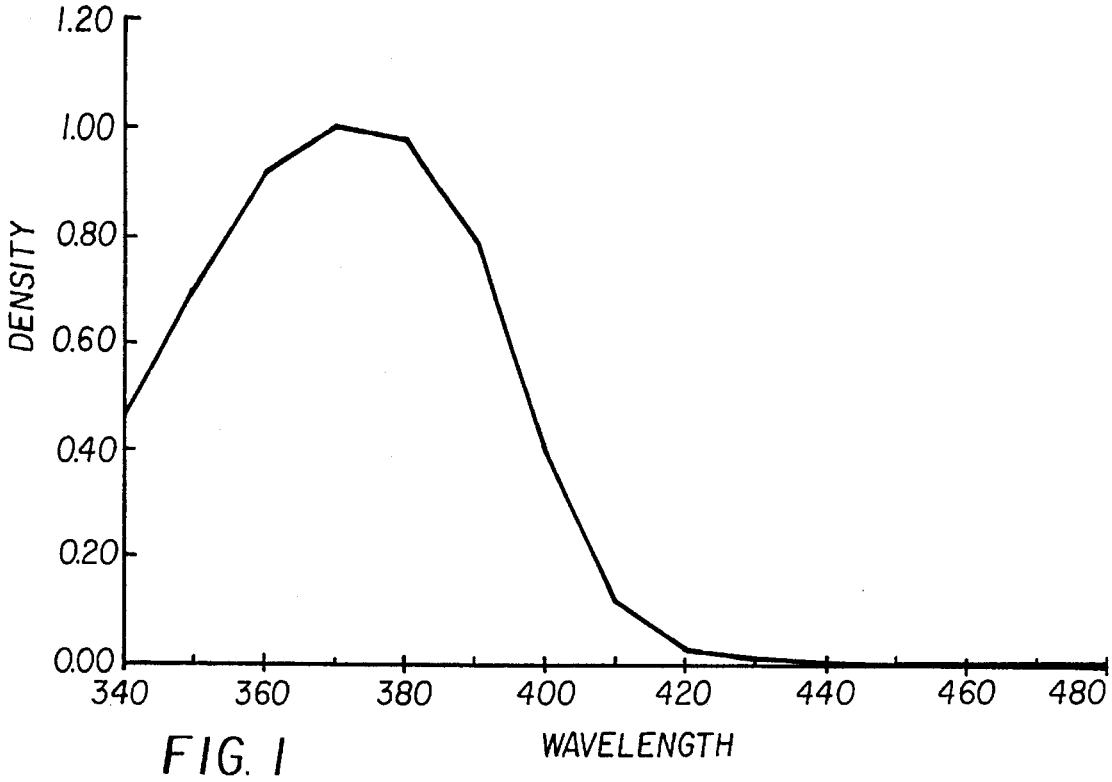
FIG. 1 depicts the absorption spectrum of a preferred UV absorbing dye.

Matrix films for imbibition printing dye transfer processes typically comprise a support bearing a light sensitive layer containing a hydrophilic colloid (typically gelatin), visible light absorbing non-photosensitive particles (typically carbon), a silver halide light sensitive emulsion, plus various photographic addenda to provide satisfactory stability, as well as coating aids necessary for suitable manufacture. Sensitizing dyes may be used in the matrix films to provide blue, green, and red light sensitivity for recording the blue, green, and red color record imagewise exposures. Separate matrix films designed to optimize sensitivity for particular color record exposures may be used, or alternatively identical pan-sensitive matrix films may be used for each of the blue, green and red exposures.

In the following discussion of suitable materials for use in the emulsions and elements that can be used in conjunction with the matrix films of the invention, reference will be made to *Research Disclosure*, Sep. 1994, Item 36544, available as described above, which will be identified hereafter by the term "*Research Disclosure*". The contents of the *Research Disclosure*, including the patents and publications referenced therein, are incorporated herein by reference, and the Sections hereafter referred to are Sections of the *Research Disclosure*, Item 36544.

Suitable silver halide emulsions and their preparation as well as methods of chemical and spectral sensitization are described in Sections I, and III–IV. Preferred silver halide emulsions for use in the matrix films of the invention are AgBrI cubic emulsions (e.g., 1–6 mole % iodide), and have an average cubic edge length of less than 0.5 microns, more preferably less than 0.3 microns, and most preferably less than 0.25 microns. Silver halide emulsions of all types generally exhibit native sensitivity to UV light. The native UV sensitivity of the silver halide emulsion is preferably used to record the toe contrast controlling UV flash. Alternatively or additionally, sensitizing dyes and/or other components may also contribute to emulsion sensitization in the UV region.

Vehicles and vehicle related addenda are described in Section II. The matrix films of the dispersions of the invention comprise a hydrophilic colloid, preferably gelatin. This may be gelatin or a modified gelatin such as acetylated gelatin, phthalated gelatin, oxidized gelatin, etc. Gelatin may be base-processed such as lime-processed gelatin, or may be acid-processed, such as acid processed ossein gelatin. The hydrophilic colloid may be another water-soluble polymer or copolymer including, but not limited to poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

Various other additives such as brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

The matrix films used in accordance with the invention may contain further features and layers as are known in the art. Preferred supports comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate).

If desired, the matrix films can be used in conjunction with an applied magnetic layer as described in *Research Disclosure*, Nov. 1992, Item 34390 published by Kenneth Mason Publications, Ltd., Dudley House, 12 North Street, Emsworth, Hampshire P010 7DQ, ENGLAND.

This invention encompasses using a UV (Ultra Violet) absorber in the blue matrix film, and more preferably in each f the red, green and blue matrix films, used in dye imbibition printing to attenuate the light in the UV region. A flash exposure is performed on the matrix film with UV light in the substantial absence of light having a wavelength above 410 nm. In accordance with conventional photographic flashing techniques, the flash exposure may be performed either before or after the imagewise exposure. UV absorbing dyes having the required absorption properties which may be used in the matrix films of the invention may be selected from UV absorber dyes described by Besio et al U.S. Pat. No. 4,849,326 (cyano substituted butamines), Logan U.S. Pat. No. 4,839,274 (acetylenic compounds), Pruett et al U.S. Pat. No. 5,215,876 (substituted styrenes), Nishijima et al EPO 0 451 813, Schofield et al EPO 0 190 003, and Umemoto U.S. Pat. No. 5,084,375 (hydroxyphenyl benzotriazoles), Leppard et al EPO 0 531 258 (triazines), Oliver U.S. Pat. No. 3,723,154 (cyanomethyl sulfone-derived merocyanines), Sawdey U.S. Pat. No. 2,739,888, 3,253,921 and 3,250,617 (thiazolidones, benzotriazoles and thiazolothiazoles), Sawdey et al U.S. Pat. No. 2,739,971, Hirose et al U.S. Pat. No. 4,783,394, Takahashi U.S. Pat. No. 5,200,307, Tanji et al U.S. Pat. No. 5,112,728, and Leppard et al EPO 0 323 408, Liebe et al EPO 0 363 820, Roth East German DD 288 249, Heller et al U.S Pat. No. 3,004,896 (triazoles), Wahl et al U.S. Pat. No. 3,125,597 and Weber et al U.S. Pat. No. 4,045,229 (hemioxonols), Diehl et al EPO 0 246 553 (acidic substituted methine oxonols), Leppard et al EPO 0 520 938 and EPO 0 530 135 (triazines), and Liebe et al EPO 0 345 514, the disclosures of which are hereby incorporated by reference. Specific examples of UV absorbers are shown below.

UV-1

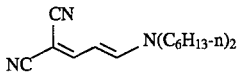

UV-2

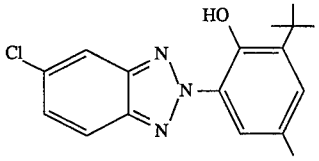

UV-3

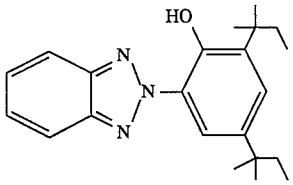

(UV-4)

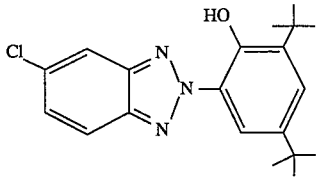

UV-5

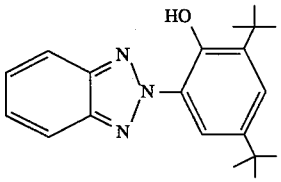

UV-6

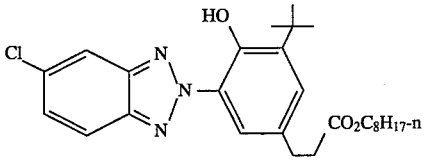

UV-7

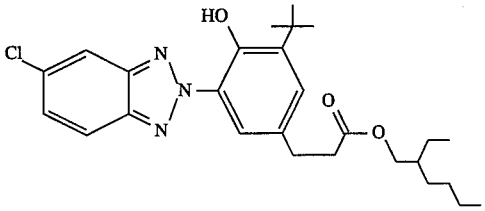

UV-8

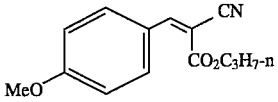

-continued

UV-9

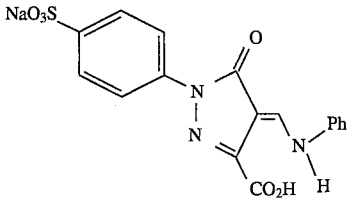

UV-10

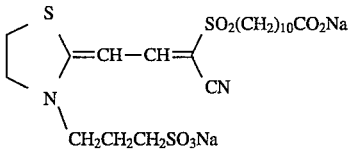

UV-11

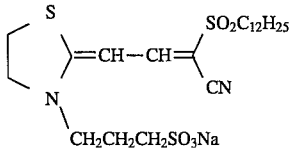

UV-12

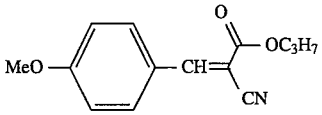

UV-13

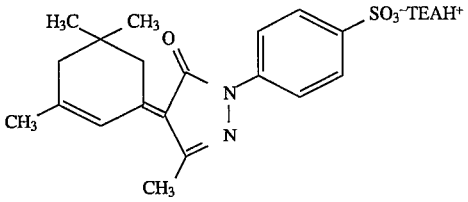

The UV absorber is selected according to its spectral characteristics, so as to provide sufficiently high absorption to the UV light flash exposure to decrease the resulting contrast of the matrix film, and sufficiently low absorption above 410 nm such that it does not significantly interfere with the imagewise exposure of the matrix film. A preferred UV-absorber absorption spectrum is depicted in FIG. 1, which is the absorption spectrum of UV absorber dye UV-1 illustrated above.

Figure 2:
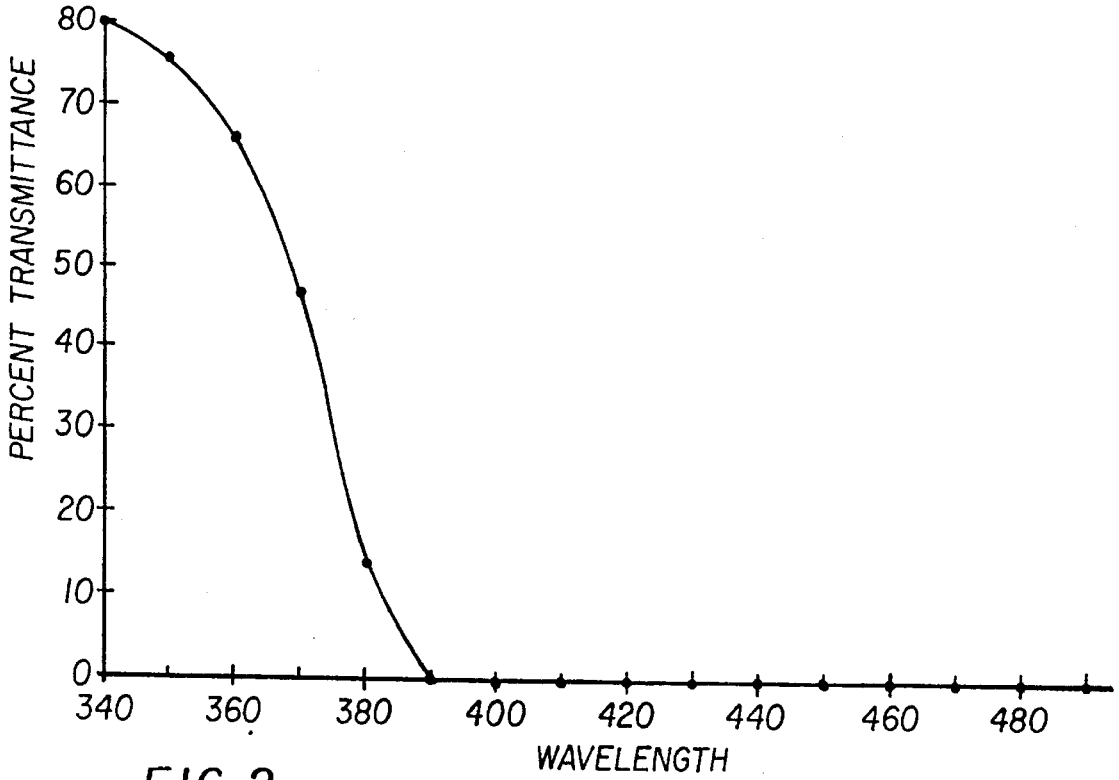
FIG. 2 depicts the spectral characteristics of a HOYA U-340 filter.

In accordance with a preferred embodiment of the invention, the UV flash exposure may be conveniently made, e.g., with a conventional tungsten or tungsten-halogen lamp printer fitted with a filter that transmits UV light and absorbs substantially all visible light above 410 nm. An example of such a filter is a HOYA U-340 filter, the spectral characteristics of which are shown in FIG. 2. As such conventional printing lamps do not provide high levels of energy below about 360 nm, the UV absorber preferably has a peak absorbance from 360 to 410 nm, and more preferably from 360 to 390 nm of the absorption spectrum. Of course, the peak absorbance may be at less than 360 nm as long as there is sufficient absorbance between 360 and 410 nm, but this would generally require the use of greater amounts of the UV absorber, which is less preferred. For printing lamps having significant energy below 360 nm, however, the UV absorber may be advantageously selected to provide a corresponding peak absorbance below 360 nm.

In the matrix film light sensitive colloid layer, there are significant levels of light absorbing particles, typically carbon particles, dispersed throughout the layer. In accordance with the invention, a UV dye is also distributed in the colloid layer. The level of contrast control depends on the concentration of the UV dye in the matrix film. As the concentration is increased, the exposure profile of the flash is biased towards the base of the matrix film, where the exposing light is incident. The total silver halide that is available for a sensitometric exposure can be represented as a straight line on a graph of relative exposure vs relative distance from the film base, as in the top line in FIG. 3. As the distance from the base is increased, more of the exposure light is absorbed, and therefore the majority of the silver halide at the top of the matrix film layer never receives exposure.

Figure 3:
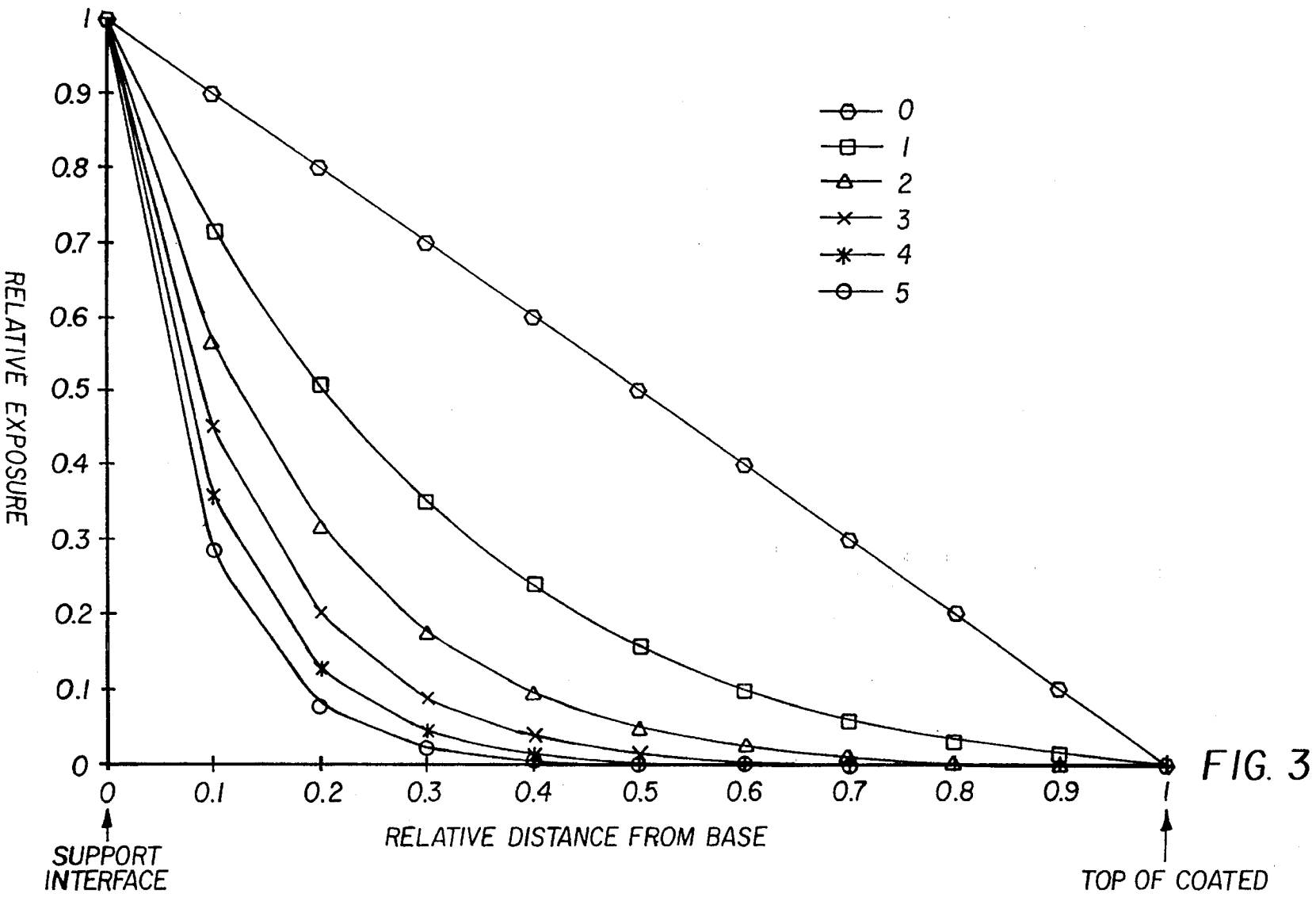
FIG. 3 is a graph depicting the Matrix Exposure Profile for matrix films having various UV dye optical densities.

The horizontal axis in FIG. 3 is the relative distance from the base of the matrix material, 0.0 is at the base and 1.0 is on the top of the film. The vertical axis is the relative intensity of an exposure through the base. Five levels of UV dye are shown in FIG. 3. The levels are such that the optical density of the specific concentration of UV dye in the spectral region used in the exposure correspond to values of 1.0, 2.0, 3.0, 4.0, and 5.0. It is easily seen that as the dye density increases, the bulk of the exposure will reside nearer to the base. In an ideal system, the actual sensitometric contrast which results from filtration will be the original contrast without any filtration reduced by the ratio of the integral of the dyed curves in FIG. 3 to the integral of the undyed curve. This technique allows the contrast control of any silver halide grain size in the imbibition matrix film with the proper choice of the UV dye concentration, filter and light source.

After formation of colloid relief images in the blue, green and red matrix films, the matrix films are dyed with yellow, magenta and cyan dyes, and the dye images are transferred to a mordant-containing receiver film. Exemplary yellow, magenta and cyan dyes which may be used in the imbibition printing process include Y-1, Y-2, M-1, and C-1 illustrated below. The imbibition receiver film, or "printing blank", typically comprises a mordanted dye-receiving layer coated on a support. Preferred imbibition printing blanks include those described in co-pending, concurrently filed, commonly assigned U.S. Ser. No. 60/000,355 filed Jun. 20, 1995, now U.S. Ser. No. 08/614,413 filed Mar. 12, 1996 (Kodak Docket No. 71550AJA) and 60/000,367 filed Jun. 20, 1995, now U.S. Ser. No. 08/614,423 filed Mar. 12, 1996 (Kodak Docket No. 71845AJA), the disclosures of which are incorporated herein by reference.

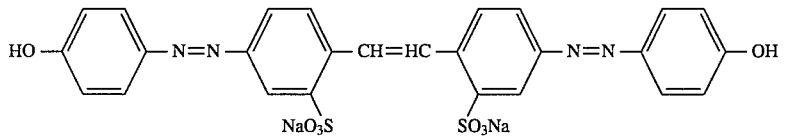

Y-1

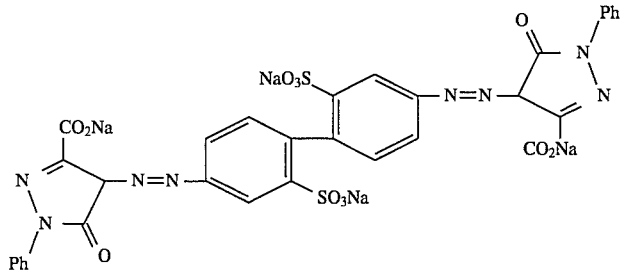

Y-2

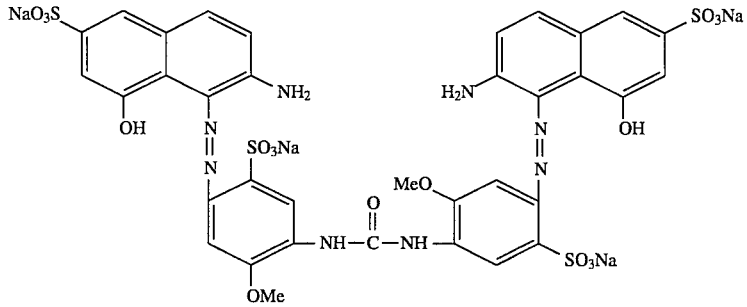

M-1

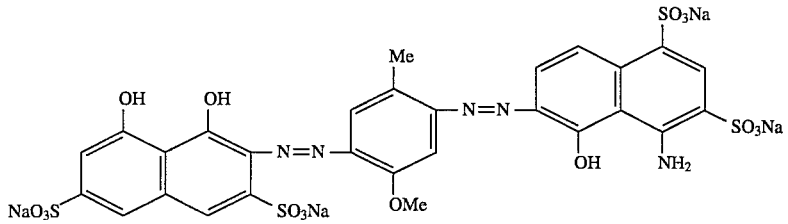

C-1

EXAMPLE 1

Blue light sensitive matrix films were coated with different levels of the UV absorber dye UV-1 (0.0, 135, 269, and 538 mg/m). The format below was used for the experiments of this example:

| Component | Coverage |
|---|---|
| Top Layer | |
| Gelatin | 883 mg/m$^2$ |
| Carbon | 323 mg/m$^2$ |
| Semicarbazide.HCl | 34 mg/m$^2$ |
| Triton X-200E (commercial surfactant) | 12 mg/m$^2$ |
| Silver Halide Layer | |
| Gelatin | 9688 mg/m$^2$ |
| Carbon | 538 mg/m$^2$ |
| Sensitized emulsion (cubic Ir-doped AgBrI with 3.4 mole % iodide and 0.21 cubic edge length, spectrally sensitized with blue sensitizing dye BSD-1) | 2422 mg/m$^2$ |
| Potassium nitrate | 255 mg/m$^2$ |
| UV absorber dye UV-1, when used | various mg/m$^2$ |

Support 5 mil clear polyester film support coated on the backside with a layer containing vanadium pentoxide (3.2 mg/m$^2$) and a polymer latex of acrylonitrile, vinylidene chloride and acrylic acid 15/9/76 wt (2.4 mg/m$^2$) followed by a layer containing Elvacite 2041 (1064 mg/m$^2$). The front side of the support was coated with a gel subbing layer.

BSD-1

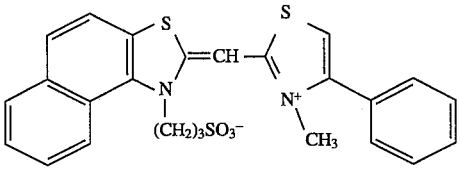

The Top Layer described above was provided to improve uniformity of the coating, processing, and antistatic performance of the matrix films, but is not necessarily required for the matrix films of the invention.

Figure 4:
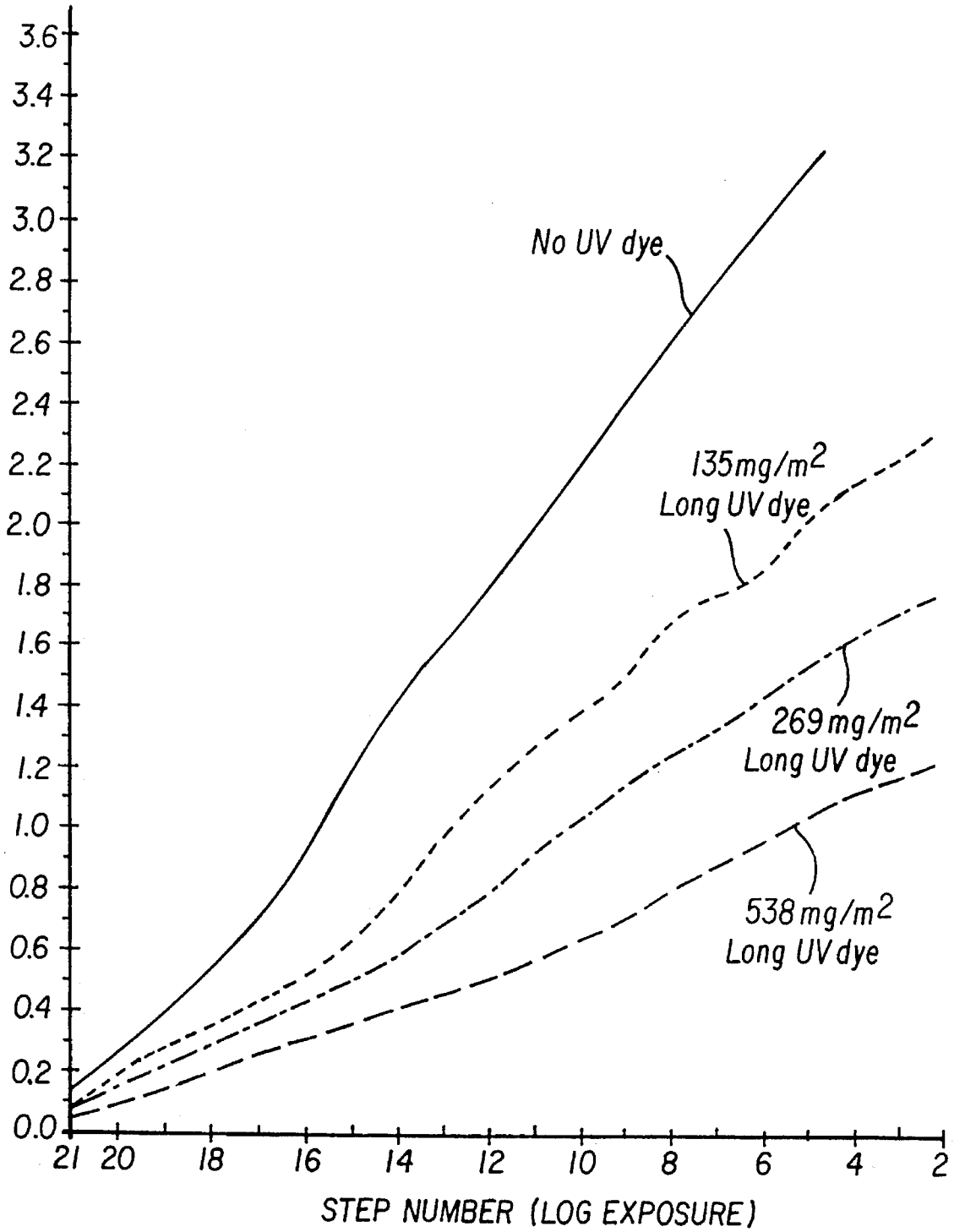
FIG. 4 depicts the sensitometric curves for matrix films having varying levels of UV absorber dye exposed to UV light resulting from Example 1.
Figure 5:
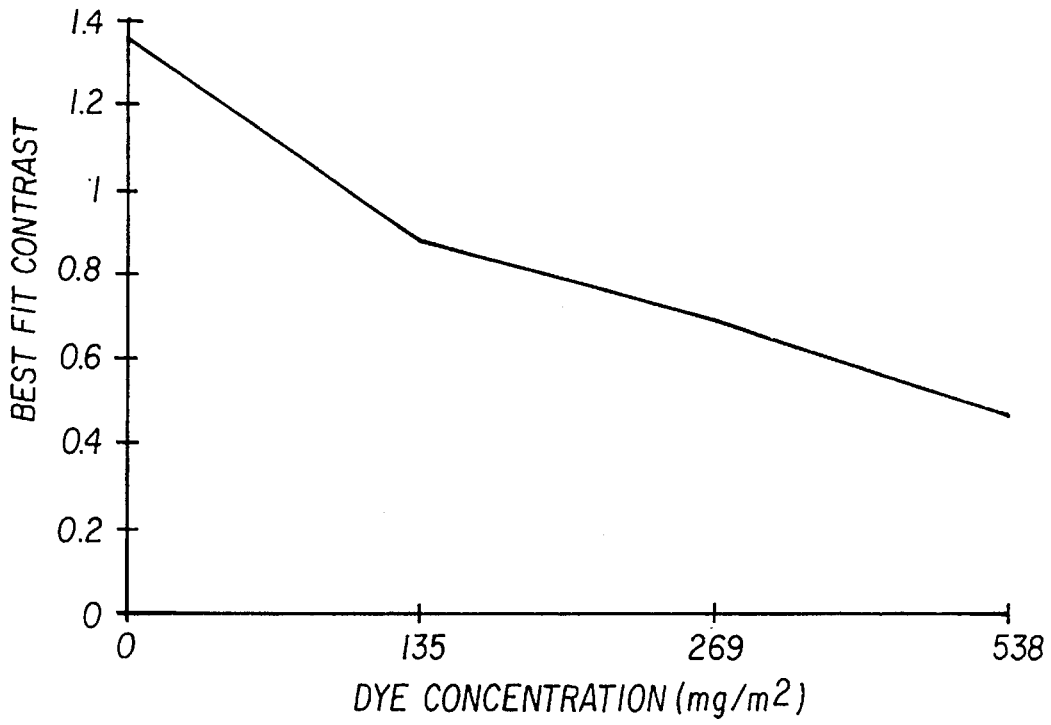
FIG. 5 is a graph depicting the Best Fit Contrasts of the curves of FIG. 4 vs. UV dye concentration.

The matrix films were exposed through a 21 step tablet on a sensitometer with a conventional tungsten lamp printer fitted with a HOYA U-340 filter (the spectral characteristics of which are shown in FIG. 2) and processed with a pyrogallol hardening developer as described in U.S. Pat. No. 2,837,430 to form a relief record. The resulting sensitometric curves for the matrix films are shown in FIG. 4. As is evident from FIG. 4, the contrast of the matrix films decreased as the UV dye concentration increased. The Best Fit Contrast (the slope of the best straight line which fits the contrast of the sensitometric curve) of the four levels of UV dye are plotted in FIG. 5. Within this range, any contrast can be attained for a flash exposure with the proper dye concentration, which in combination with an imagewise exposure enables effective and selective toe contrast control for the resulting relief image.

EXAMPLE 2

Not all UV absorbers will work effectively with conventional tungsten or tungsten-halogen lamp printers fitted with a filter that transmits UV light and absorbs substantially all visible light above 410 run. The peak wavelength of the UV absorber selected for use with such printers is preferably above 360 nm (but still below 410 nm), as tungsten lamps typically have minimal energy below 360 nm. The native blue sensitivity of the silver halide is active within this 360–410 nm wavelength range. If the UV dye absorption peak is relatively short (such as 350 nm), it may not have the ability to attenuate light in the range where a tungsten or tungsten-halogen lamp produces energy and the matrix film senses the energy.

Figure 6:
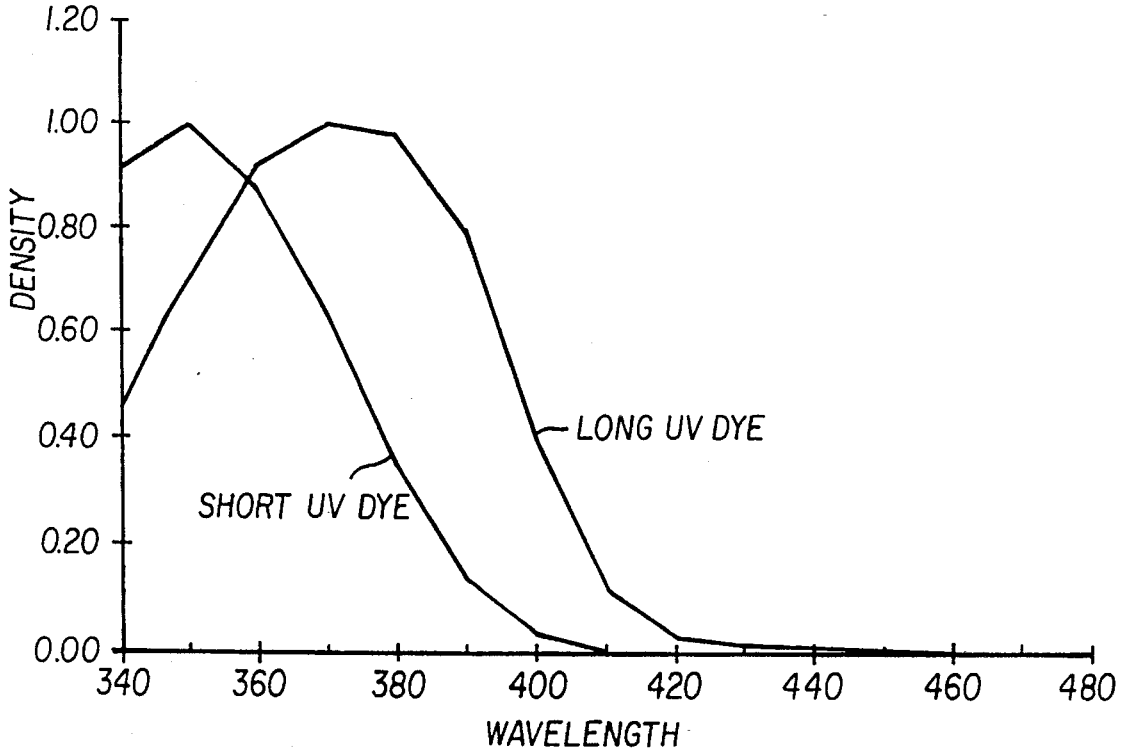
FIG. 6 depicts the absorption spectra of the UV absorbing dyes used in Example 2.
Figure 7:
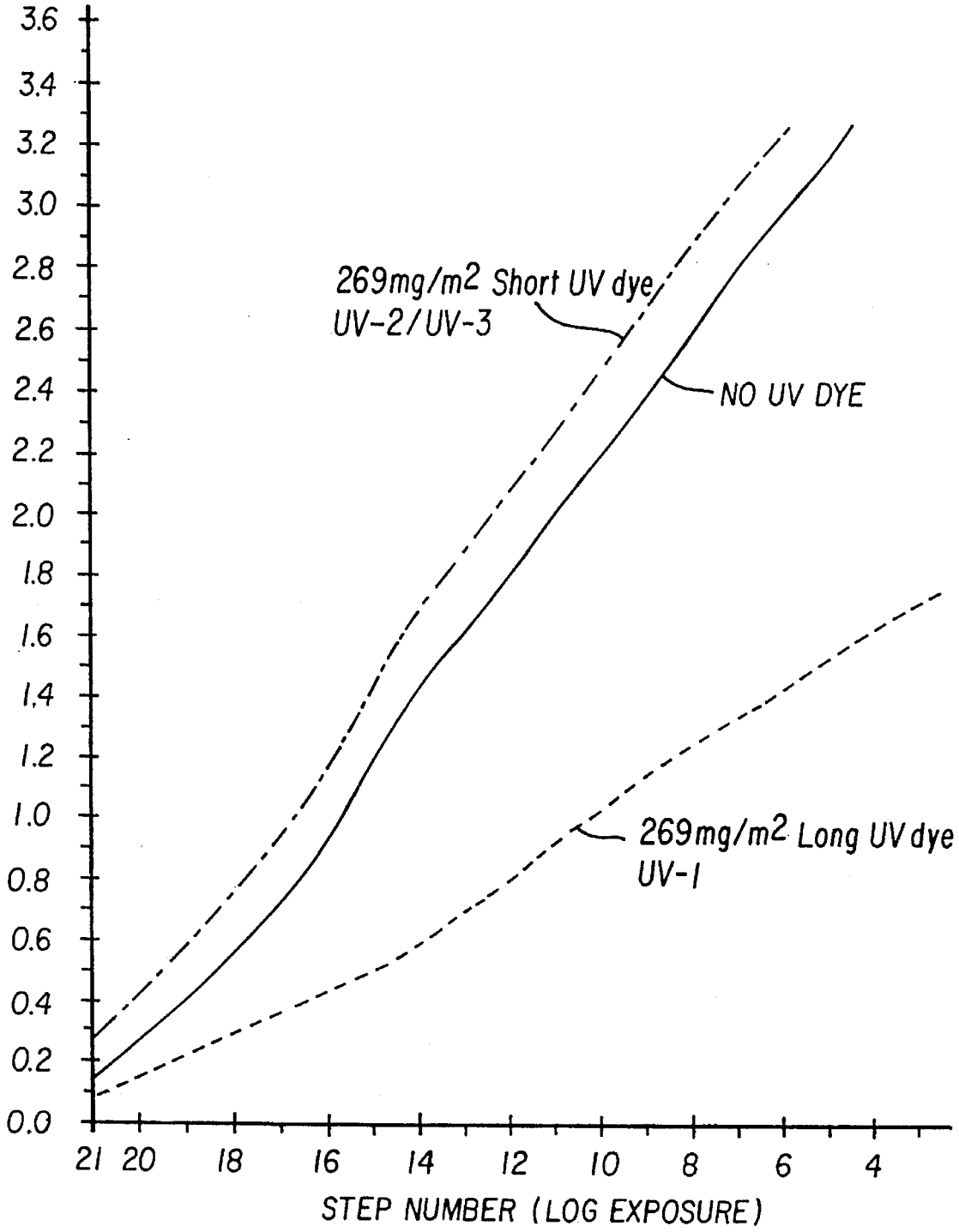
FIG. 7 depicts the sensitometric curves for the matrix films exposed to UV light resulting from Example 2.

Example 1 was essentially repeated, except for substituting a mixture of UV absorber dyes UV-2 and UV-3 for dye UV-1. A comparison of the UV absorbers is shown in FIG. 6, where the absorbance spectrum on the right in FIG. 6 with the longer wavelength peak is that of dye UV-1, while absorbance spectrum on the left in FIG. 6 with the shorter wavelength peak is that of the mixture of dyes UV-2 and UV-3. FIG. 7 shows the sensitometry of the experimental results. The three curves plotted are three similar blue matrix films with 0.0 mg UV dye, 269 mg/m$^2$ of UV-1 and 269 mg/m$^2$ of UV-2/UV-3. The sensitometry of the matrix film without dye and the matrix film with 269 mg/m$^2$ of the shorter peaked absorber dyes (UV-2/UV-3) are similar in contrast. Thus, the shorter peaked UV absorber did not work in this case in combination with a tungsten lamp UV flash to reduce contrast, while the matrix film with 269 mg/m$^2$ of UV-1 did exhibit a large contrast change.

EXAMPLE 3

Red and green light sensitive matrix films of the following formats were coated with different levels of the UV absorber dye UV-1 and exposed and processed similarly as described in Example 1.

| Component | Coverage (Red Matrix) | Coverage (Green Matrix) |
|---|---|---|
| Silver Halide Layer | | |
| Gelatin | 10764 mg/m$^2$ | 9688 mg/m$^2$ |
| Carbon | 431 mg/m$^2$ | 538 mg/m$^2$ |
| Sensitized emulsion | 1938 mg/m$^2$ (cubic Ir-doped AgBrI with 3.4 mole % iodide and 0.13 cubic edge length, spectrally sensitized with red sensitizing dye RSD-1) | 1722 mg/m$^2$ (cubic Ir-doped AgBrI with 3.4 mole % iodide and 0.09 cubic edge length, spectrally sensitized with green sensitizing dyes GSD-1 and GSD-2) |
| Yellow dye YD-1 | 2368 mg/m$^2$ | 2799 mg/m$^2$ |
| UV absorber dye UV-1 | various mg/m$^2$ | various mg/m$^2$ |

Support 5 mil clear polyester film support coated on the backside with a layer containing vanadium pentoxide (3.2 mg/m$^2$) and a polymer latex of acrylonitrile, vinylidene chloride and acrylic acid 15/9/76 wt (2.4 mg/m$^2$) followed by a layer containing Elvacite 2041 (1064 mg/m$^2$). The front side of the support was coated with a gel subbing layer.

YD-1

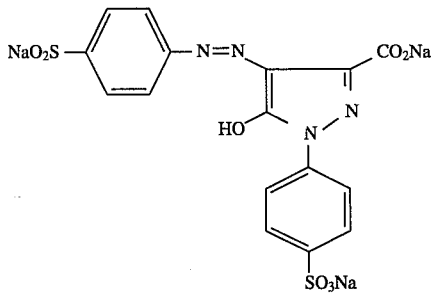

-continued

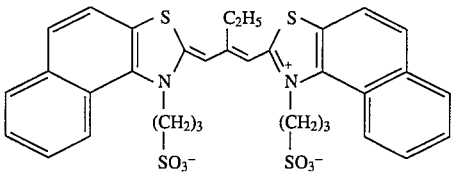

RSD-1

$HN^+(C_2H_5)_3$

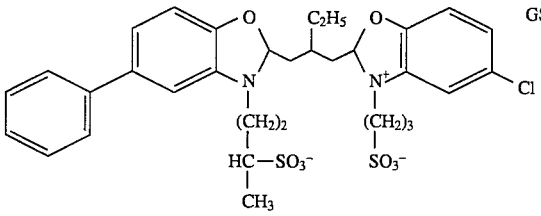

GSD-1

$Na^+$

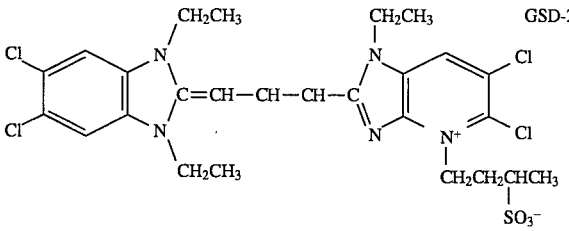

GSD-2

The matrix films contained further conventional photographic coating addenda well known in the art. Similar contrast reduction for the red and green matrix films was observed dependent upon the UV absorber concentration as was observed for the blue matrix films of Example 1.

While the invention has been described in detail and with reference to specific embodiments thereof, it will be apparent to one skilled in the art that various changes and modifications can be made therein without departing from the spirit and scope thereof.

We claim:

1. In a process for exposing a dye imbibition printing matrix film comprising imagewise exposing a matrix film comprising a visible light sensitive silver halide emulsion containing colloid layer on a support to blue, green or red light., the improvement wherein the visible light sensitive emulsion is also sensitive to UV light and the toe contrast of the imaged matrix film is controlled by (i) incorporating a UV absorber in the colloid layer of the matrix film, and (ii) flash exposing the matrix film with UV light in the substantial absence of light having a wavelength above 410 nm, wherein the UV absorber provides sufficiently low absorption above 410 nm such that it does not substantially alter the effective photographic speed of the matrix film during the imagewise exposure or the mid scale contrast of the imaged matrix film, and sufficiently high absorption to the UV light to decrease the resulting toe contrast of the imaged matrix film.

2. A process according to claim 1, wherein the matrix film comprises a blue light sensitive silver halide emulsion which is imagewise exposed to blue light.

3. A process according to claim 1, wherein the matrix film comprises a green light sensitive silver halide emulsion which is imagewise exposed to green light.

4. A process according to claim 1, wherein the matrix film comprises a red light sensitive silver halide emulsion which is imagewise exposed to red light.

5. A process according to claim 1, wherein the matrix film comprises a pan-sensitive silver halide emulsion.

6. A process according to claim 1, wherein the flash UV exposure is performed with a tungsten or tungsten-halogen lamp and a filter that transmits UV light and absorbs substantially all light above 410 nm.

7. A process according to claim 6, wherein the UV absorber has peak absorbance between 360 and 410 nm.

8. A process according to claim 1, wherein the UV absorber has peak absorbance between 360 and 410 nm.

9. A process according to claim 1, wherein the UV absorber has peak absorbance between 360 and 390 nm.

10. A process according to claim 1, wherein the UV absorber is

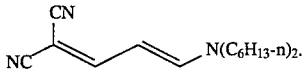

11. A process according to claim 1, wherein the UV flash exposure is performed after the imagewise exposure.

12. A process according to claim 1, wherein the UV flash exposure is performed before the imagewise exposure.

13. In a process for imagewise exposing dye imbibition printing matrix films comprising:

a) imagewise exposing a blue matrix film comprising a blue light sensitive silver halide emulsion containing colloid layer on a support to blue light;

b) imagewise exposing a green matrix film comprising a green light sensitive silver halide emulsion containing colloid layer on a support to green light; and c) imagewise exposing a red matrix film comprising a red light sensitive silver halide emulsion containing colloid layer on a support to red light;

the improvement wherein the blue light sensitive emulsion is also sensitive to UV light and the toe contrast of the blue matrix film is controlled by d) incorporating a UV absorber in the colloid layer of the blue sensitive matrix film; and e) flash exposing the blue sensitive matrix film with ultraviolet light in the substantial absence of light having a wavelength above 410 nm;

wherein the UV absorber provides sufficiently low absorption above 410 nm such that it does not substantially alter the effective photographic speed of the blue matrix film during imagewise exposure step (a) or the mid scale contrast of the imaged blue matrix film, and sufficiently high absorption to the UV light to decrease the resulting toe contrast of the imaged blue matrix film.

14. A process according to claim 13, wherein the green and red light sensitive silver halide emulsions are also sensitive to UV light, and the toe contrasts of the green and red matrix films are also controlled by incorporating a UV absorber in the colloid layers thereof and flash exposing each matrix film with UV light in the substantial absence of light having a wavelength above 410 nm; wherein the UV absorber provides sufficiently low absorption above 410 nm such that it does not substantially alter the effective photographic speed of the green and red matrix films during imagewise exposure steps (b) and (c) or the mid scale contrasts of the imaged green and red matrix films., and sufficiently high absorption to the UV light to decrease the resulting toe contrasts of the imaged green and red matrix films.

* * * * *

UNITED STATES PATENT AND TRADEMARK OFFICE

CERTIFICATE OF CORRECTION

PATENT NO. : 5,620,833
DATED : April 15, 1997
INVENTOR(S) : Mitchell J. Bogdanowicz, Charles P. Hagmaier, and Roger W. Nelson It is certified that error appears in the above-identified patent and that said Letters Patent is hereby corrected as shown below:

| | |
|---|---|
| Title Page | After item [22], insert --Related U.S. Application Data [60] Provisional Application Serial No. 60/000,356, filed June 20, 1995.-- |
| Column 1, line 4 | insert --CROSS REFERENCE TO RELATED APPLICATION<br>Reference is made to and priority claimed from U.S. Provisional Application Serial No. US 60/000,356, filed June 20, 1995, entitled CURVE SHAPE CONTROL IN A PHOTOGRAPHIC IMBIBITION DYE TRANSFER PROCESS.-- |

Signed and Sealed this

Sixteenth Day of December, 1997

*Attest:*

*Attesting Officer*

BRUCE LEHMAN

*Commissioner of Patents and Trademarks*